United States Patent [19]

Stevenson

[11] 4,215,950

[45] Aug. 5, 1980

[54] TENSIONER DEVICE FOR OFFSHORE OIL PRODUCTION AND EXPLORATION PLATFORMS

[75] Inventor: William D. Stevenson, Edinburgh, Scotland

[73] Assignee: Brown Brothers & Company, Ltd., Edinburgh, Scotland

[21] Appl. No.: 899,478

[22] Filed: Apr. 24, 1978

[30] Foreign Application Priority Data

Apr. 23, 1977 [GB] United Kingdom ..... 17001/77

[51] Int. Cl.[2] ..... B63B 21/52; B63B 51/02

[52] U.S. Cl. ..... 405/195; 114/264; 175/5; 166/359; 254/29 R; 9/8 P

[58] Field of Search ..... 175/5, 7, 27; 166/359; 214/1 P; 254/29 R; 114/230, 264, 293; 9/8 P; 405/195, 203

[56] References Cited

U.S. PATENT DOCUMENTS

| | | | |
|---|---|---|---|
| 3,390,654 | 7/1968 | Bromell | 114/264 |
| 3,496,898 | 2/1970 | Morgan | 175/7 |
| 3,508,409 | 4/1970 | Cargile | 175/5 |
| 3,581,506 | 6/1971 | Howard | 175/7 |
| 3,760,875 | 9/1973 | Busking | 166/359 |
| 3,917,006 | 11/1975 | Kellner | 175/27 |
| 3,919,958 | 11/1975 | Graham | 114/264 |

*Primary Examiner*—Trygve M. Blix
*Assistant Examiner*—D. W. Keen
*Attorney, Agent, or Firm*—Larson, Taylor and Hinds

[57] ABSTRACT

A tensioner device which operates in conjunction with an oil production riser incorporates a gimbal device having two relatively movable elements. One of said elements is connectible to the riser and to one of the relatively movable members of at least one pair of tensioner cylinder and piston units and the other member is connectible to a platform supporting the tensioner device. Guiding members carried by the other element of the gimbal device are operative to guide the gimbal device in a direction axially of the riser.

11 Claims, 6 Drawing Figures

TENSIONER DEVICE FOR OFFSHORE OIL PRODUCTION AND EXPLORATION PLATFORMS

Figure 1:
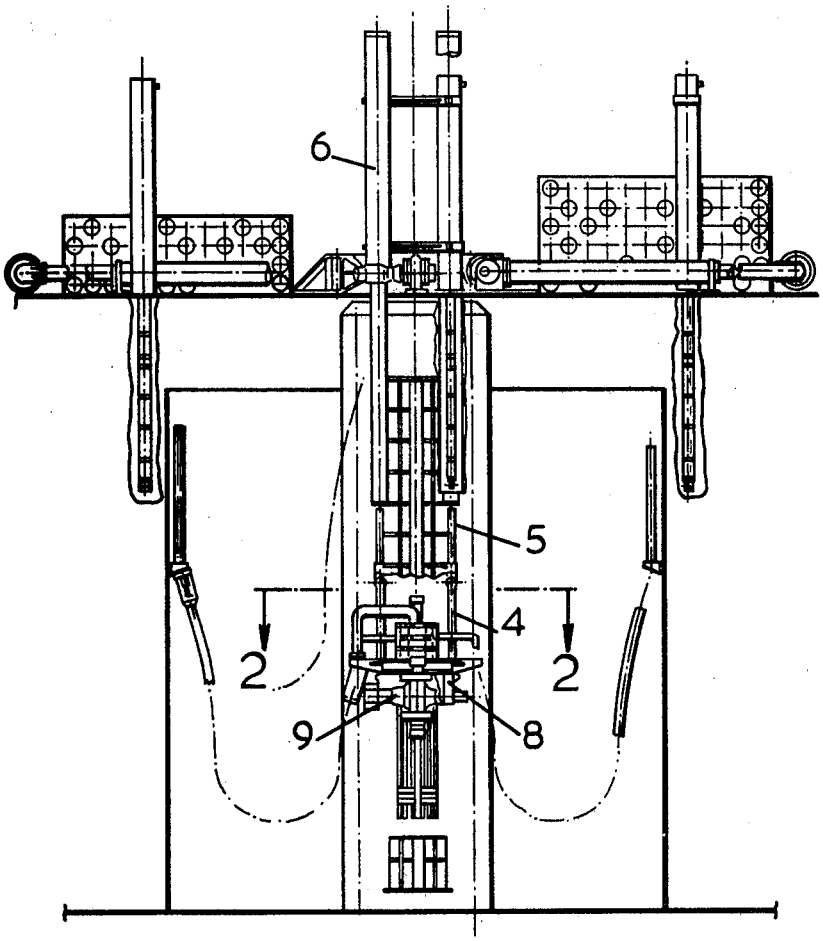

This invention relates to a tensioner device for use with oil production equipment on a platform which may be located on a fixed or floating rig or may be located on a vessel.

The arrangement for receiving oil from a bore or several bores and transferring it to a loading point normally incorporates a riser supporting an export header/-production line unit. The riser is normally suspended from the platform by what is known as a tensioner system. Known tensioner systems utilize wire ropes which pass over guide sheaves attached to the decks of the platforms or vessels. These wire ropes are anchored at one end to tensioning apparatus on the structure of the platforms or vessels and are attached at the other end to the risers which are thus suspended by the wire ropes.

In the known constructions a source of considerable trouble is rope breakage. Also the deck of the platform or vessel is heavily loaded by the force emanating from the guide sheaves.

It is an object of the present invention to provide a tensioner device for supporting a riser which dispenses with wire ropes, relieves the deck of the platform or vessel of any load arising from the tensioner system and which may be arranged to make provision for maintaining the desired tensioning force on the riser in the event of failure of part of the tensioner device.

A tensioner device according to the invention incorporates a gimbal device connectible to a riser, at least one pair of tensioner cylinder and piston units the relatively movable members of which are connected respectively to the platform and to the gimbal device and guiding means operative to guide the gimbal device in a direction axially of the riser.

The cylinder and piston units may be disposed around the riser parallel to the riser. In this construction the members of the cylinder and piston units connected to the platform may be rigidly fixed thereto. The other relatively movable members may be rigidly fixed or may be connected to the gimbal device by pivot connections or by universal joints.

The gimbal device may incorporate an inner ring and an outer ring to which the inner ring is pivotally connected, said inner ring being pivoted to the tensioner cylinder and piston units. The outer ring may carry guide rollers, vertical guide rails being provided with which the guide rollers are engaged, the axis of the pivotal connection of the inner to the outer ring lying in a vertical plane midway between the guide rails.

Preferably there are at least two pairs of tensioner cylinder and piston units disposed equi-angularly around the gimbal ring, the cylinders of each pair being diametrically opposite one another.

The cylinders of each tensioner cylinder and piston unit may be non-parallel to the riser and are then pivoted to a fixed part of the platform, the end of the piston projecting from each cylinder being pivotally or universally connected to the inner ring of the gimbal device. Each cylinder may be pivoted to the platform at either end or at a position intermediate the ends. The cylinders may be so arranged that the pistons project upwardly, i.e. the gimbal device is above the cylinders, or they may be arranged to project downwardly so that the gimbal device is below the cylinders.

The tensioner cylinder units may be of the telescopic type, i.e. the piston members may be in several sections slidable within one another so as to provide a long stroke within a short closed length.

The tensioner cylinders may be coupled to a fluid pressure system by valve means providing a facility for operating each pair of cylinders diametrally opposite one another as an independent pair. The fluid pressure system may also include a facility for increasing the pressure above the normal working pressure when desired. An alarm system may be provided to give notice of this situation.

The fluid pressure system may incorporate pressure failure sensors connected separately to all the cylinders, means being provided when a pressure failure sensor senses a loss of pressure in the circuit associated with one pair of cylinders to operate to disconnect that circuit from the fluid pressure system and increase the pressure in the other cylinders by an amount sufficient to provide the same total supporting thrust.

Figure 2:
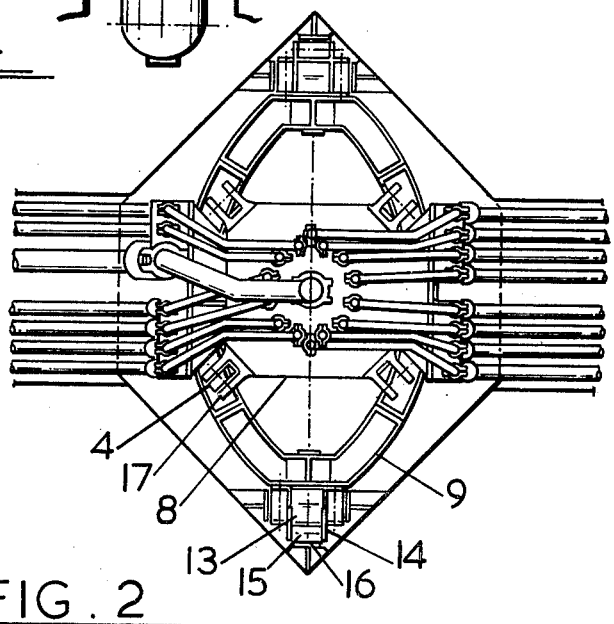
Figure 3:
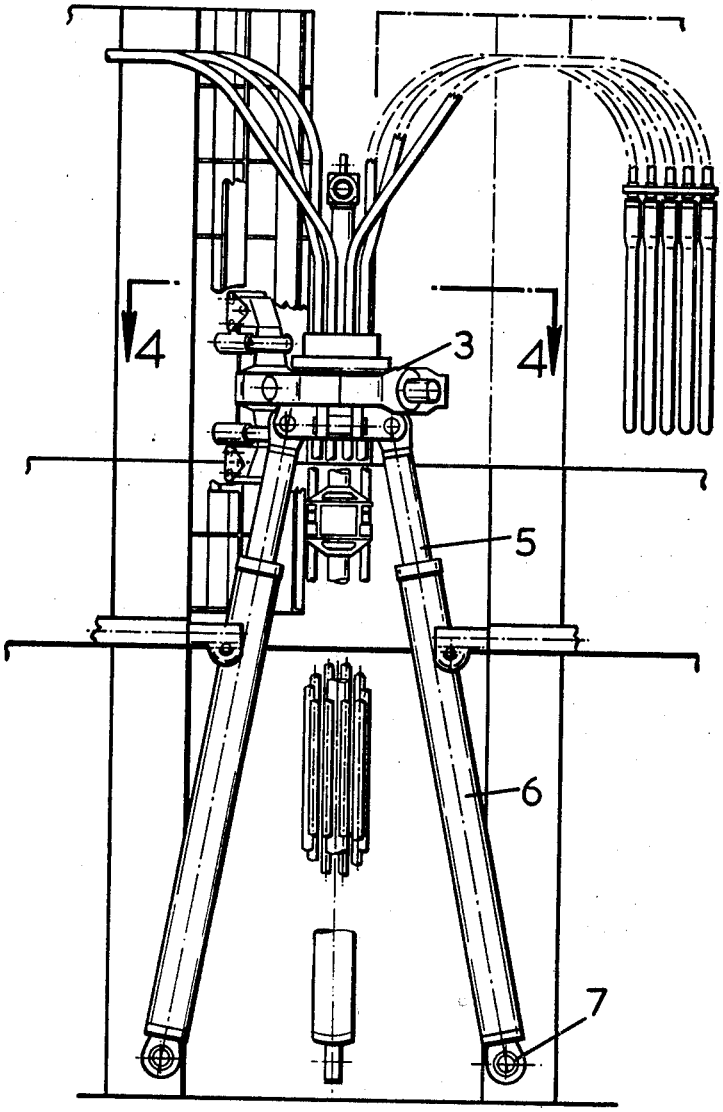

Practical embodiments of the invention are illustrated in the accompanying drawings in which FIG. 1 illustrates one embodiment of a tensioner device incorporating cylinders rigidly fixed to the drilling platform, FIG. 2 is a section through the line 2—2 in FIG. 1 and FIG. 3 illustrates another embodiment of a tensioner device in which the cylinders are non-parallel to the riser and are pivoted to a fixed part of the platform with the pistons of the cylinders projecting upwardly so that the gimbal device is above the cylinders.

Figure 4:
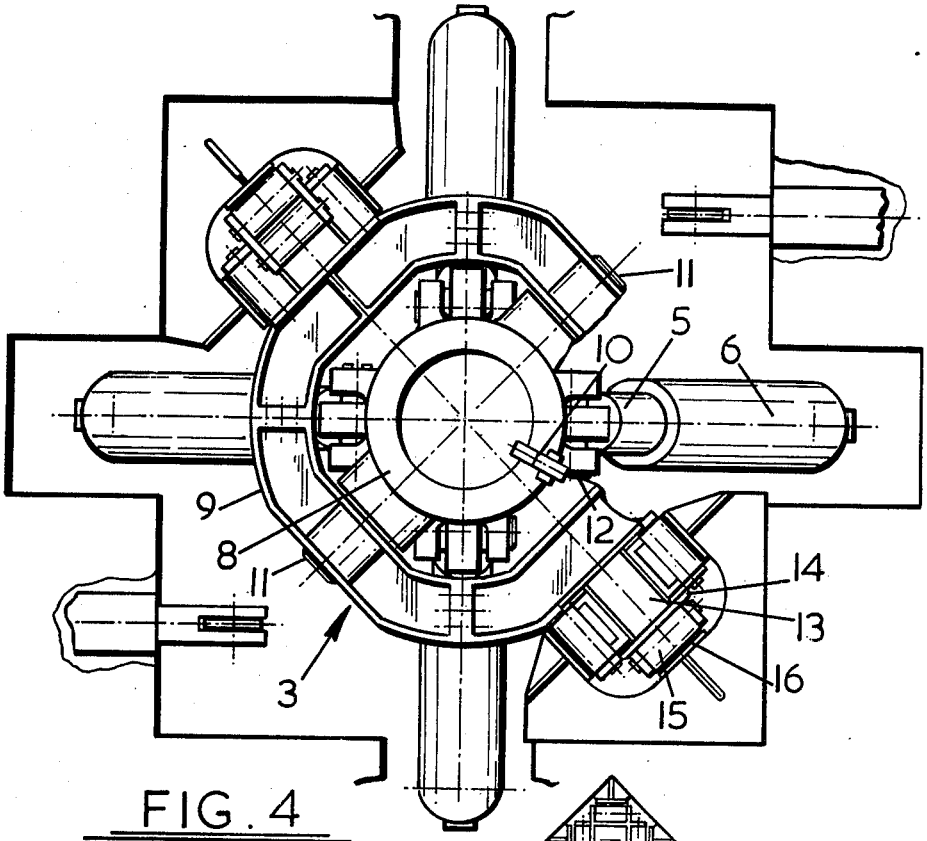

FIG. 4 is a section through the line 4—4 in FIG. 3. For clarity of illustration the riser is not shown in FIG. 4 but passes through the inner ring 8.

Figure 5:
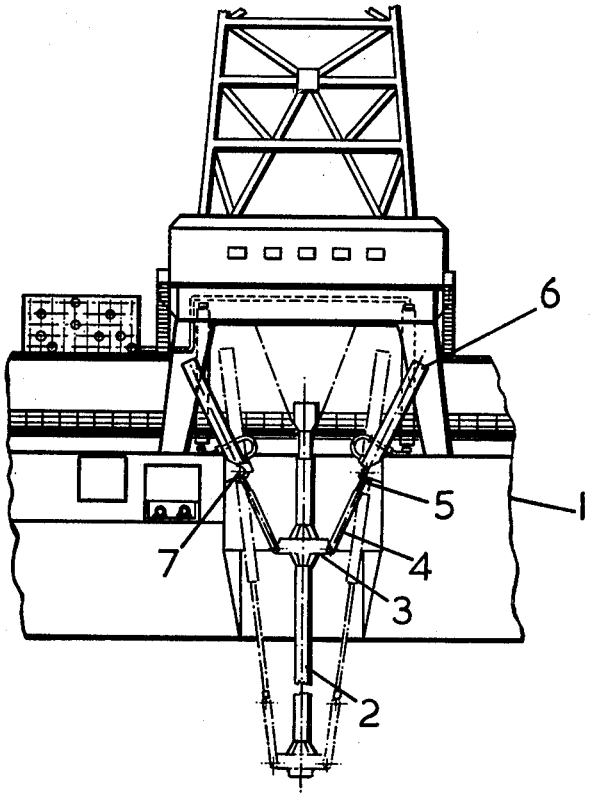
Figure 6:
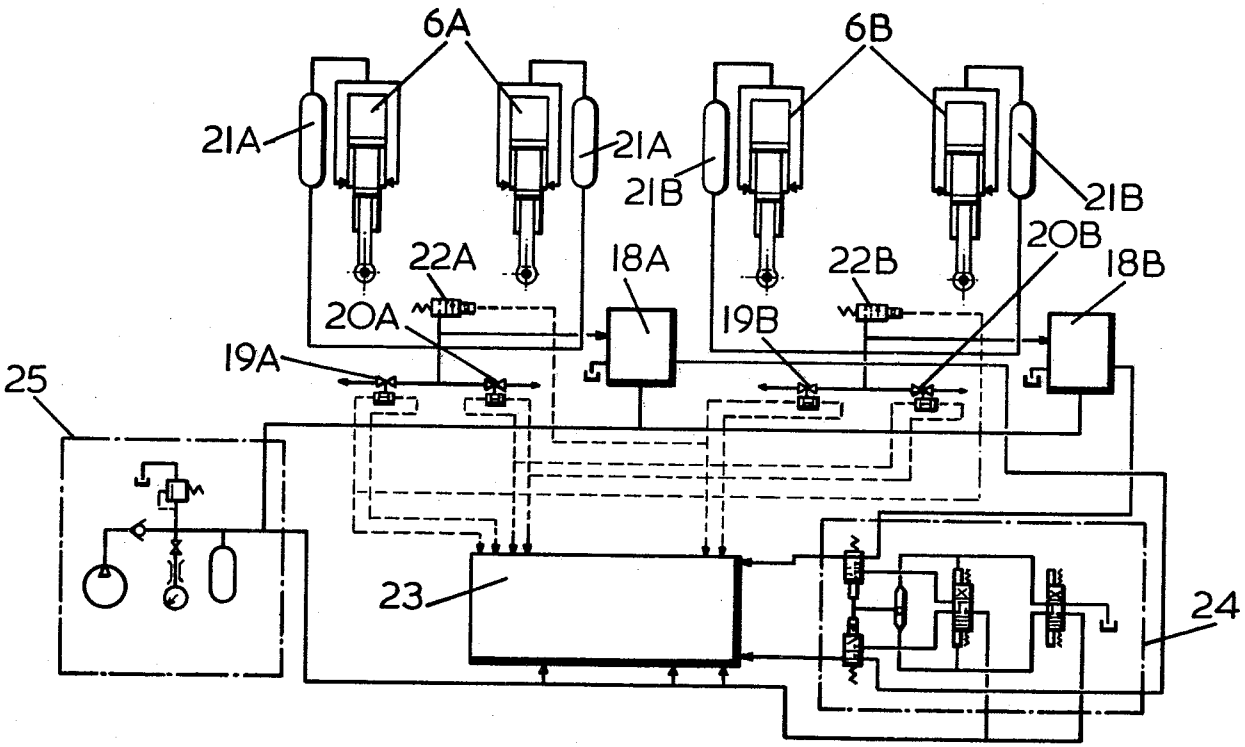

FIG. 5 illustrates semi-diagrammatically another construction in which the cylinders are non-parallel to the riser but in which the cylinders are so arranged that the pistons project downwardly, that is the gimbal device is below the cylinders and FIG. 6 is a simplified diagram of a fluid pressure system for the tensioner device incorporating means for providing compensation for failure in the supply of operating fluid to one of the pairs of cylinders.

In the drawings and referring first to FIG. 1, 1 denotes a production platform, 2 denotes a production riser, the full lines denoting the uppermost position of the riser and the chain-dotted lines indicating the lowermost position of the riser. 3 denotes a gimbal device attached to the riser by way of a spider supported by the gimbal device, said gimbal device being connected by links 4 to pistons 5 movable in cylinders 6. In the construction illustrated in FIGS. 3 and 5, the pistons 5 and cylinders 6 constitute cylinder and piston units pivoted at 7 to fixed parts of the platform 1 and 5. In the arrangement of FIG. 1 the cylinders are so directed that the pistons project downwardly so that the gimbal device 3 is below the cylinders. In the arrangement of FIG. 3 the gimbal device 3 is above the cylinders. The cylinders 6 are hydropneumatic cylinders arranged to be charged under pressure from a supply of compressed air.

In the other drawings those parts corresponding with the same parts in FIG. 1 bear the same reference numerals as those in FIG. 1. Referring now to FIGS. 3 and 4 6A and 6B denote respectively the diametrically opposite pairs of cylinders 6A and 6B of two pairs of cylinders pivoted at 7 to fixed parts of the platform in such a way that the pistons 5 project upwardly so that the gimbal device 3 is above the cylinders numbers. 8 and 9 (FIG. 3) denote inner and outer rings respectively constituting the gimbal device 3. The inner ring 8 supports the spider which in operation is clamped to the riser 2. One clamping element of the spider is indicated at 10, the rest of the spider being omitted for reasons of clarity of illustration. The inner ring 8 is pivoted to the outer ring 9 by diametrically opposite pivots 11. The pistons 5 of the cylinders 6A and 6B are pivoted at 12 to the inner ring 8. The outer ring 9 carries diametrically opposite pivot pins 13 the axes of which are at right angles to the axes of the pivots 11. The pivot pins 13 engage brackets 14 supporting guide rollers 15 engaging guide rails 16. One bracket 14 has been omitted from FIG. 3 for reasons of clarity of illustration.

Referring again to FIG. 1, the cylinders 6 are arranged in diametrically opposite pairs fixed to the platform 1, the opposite pairs of cylinders having arranged as the cylinders 6A and 6B of FIG. 4. The links 4 are pivoted to the lugs 17 presented by the inner ring 8 of the gimbal device (see FIG. 2). Other parts illustrated in FIG. 2 bearing the numerals 9, 13, 14, 15 and 16 correspond with the components bearing the same numerals in FIG. 4. The pivots by which the inner ring 8 is connected to the outer gimbal ring 9 cannot be seen in FIG. 5 but these pivots have all axes at right angles to the axes of the pivot pins 13.

Referring to FIG. 6 which shows the part of the operating fluid pressure circuit incorporating pressure failure sensors, 18A and 18B denote sensors arranged to sense failure of pressure in the circuit supplying the cylinders 6A and 6B respectively, each pair of cylinders being connectible alternatively from a high pressure air bank and a low pressure air bank by means of valves 19A and 20A respectively for the cylinders 6A and 19B and 20B respectively for the cylinders 6B. The two valves 19A and 20A are pressure operated and are connected to the two cylinders 6A by way of the hydro-pneumatic accumulators 21B. The circuit of the cylinders 6A is also connected to a bleed-off valve 22A which is spring loaded to the closed position but may be pressure operated to open to a discharge line and the valves 19B and 20B are connected to a bleed-off valve 22B which is spring loaded to the closed position but may be pressure operated to open to a discharge line. The valves 19A and 20A and 19B and 20B are arranged to be pressure operated so that they may be set alternatively to the open or the closed position, the operating pressure being supplied under the control of a control unit 23 arranged to be itself controlled by the pressure failure sensors 18A and 18B. The connection between the pressure failure sensors 18A and 18B and the control unit 23 is by way of a manual control system 24 which can be arranged to override the automatic control of the control unit 23. Power for the pressure failure sensors 18A and 18B is provided from a low pressure compressor unit 25.

In practice, the production riser 2 is gripped by the spider supported by the inner ring 8 which is pivoted to the outer ring 9 of the gimbal device 3. The inner ring 8 is attached by pivots 12 to the pistons 5 of the cylinders 6A and 6B and since the cylinders 6A and 6B are attached to a fixed part of the platform the weight of the riser is carried by the platform when the cylinders 6A and 6B are charged with fluid at a pressure appropriate to the conditions. The cylinders are supplied with operating fluid from the accumulators 21A and 21B, the pressure of the fluid in the cylinders being adjusted by the air pressure applied above the level of the fluid in the accumulators 21A and 21B. As the cylinders 6A and 6B are attached to a fixed part of the structure of the platform whether a rig or a vessel the deck of the rig or vessel does not require to support the weight of the riser. Vertical movement of the riser 2 is obtained by adjusting the air pressure applied on the surface of the fluid in the accumulator cylinders 21A and 21B.

In the constructions of FIGS. 1 and 2 changes in the vertical position of the riser necessitate swinging movement of the cylinders 6A and 6B about the pivots 7 by which the cylinders are connected to the platform. The pivotal connection of the pistons 5 to the inner ring 8 allows the riser 2 to move linearly as the cylinders swing. In the construction of FIG. 4 the cylinders which are parallel to the axis of the riser remain fixed in position and no provision is made to allow them to swing. As the riser moves vertically the outer ring 9 of the gimbal device 3 is guided by contact of the rollers 15 against the guide rails 16. The gimbal device prevents transverse stresses from being applied to the riser despite movement of the platform particularly where it is a floating platform.

In normal operation of the tensioner device the valves 22A and 22B are held by their springs in the closed position and the valves 19A and 19B are also in the closed position while the valves 2A and 2B are open. Low pressure air is then supplied through the valves 20A and 20B to the accumulators 21A and 21B and provide a pressure on the underside of the pistons of the cylinders 6A and 6B which is the normal supporting pressure with all cylinders working, the combined thrust provided by all the cylinders being sufficient to support the riser. If a failure should occur anywhere in the circuit associated say with the cylinders 6A so that there is loss of pressure in that circuit the failure sensor 18A will immediately sense the loss of pressure and will provide an indication of such loss to the automatic control unit 23. The automatic control unit will now operate to move the valve 22A against its spring to connect the circuit associated with the cylinders 6A to a discharge line and to close the valve 20A while maintaining the valve 19A closed. At the same time the control unit will close the valve 20B and open the valve 19B to admit high pressure air to the accumulators 21B and thus increase the pressure of the operating fluid in the cylinders 6B whereby to increase the supporting force provided by these cylinders so that the riser remains supported. As the cylinders are arranged in pairs the system remains balanced transversely and the same supporting load is maintained on the riser. What in other constructions could be a disastrous situation is thus immediately avoided in the device according to the invention and the platform can continue functioning normally. An alarm system normally incorporated provides a warning that failure associated with one pair of cylinders has taken place so that immediate steps can be taken for repairs to be made. Even without failure of one of the circuits any pair of cylinders can be taken out of use for inspection or maintenance without taking the platform out of service so that the heavy financial loss normally occurring when a platform has to be taken out of service for repair, inspection or maintenance of the tensioning apparatus is eliminated. To take one of the pairs of cylinders out of service the manual control system 24 is operated to perform the same action as the pressure sensor initiates at a true failure.

The device of the invention completely eliminates the use of wire ropes. This has the immediate effect of removing operating stresses from the deck of the platform whether a fixed or a floating platform. With a wire rope system because of the large bulk of the apparatus the deck of the platform is the only surface which can conveniently accommodate it. Extra deck space is thus made available. Another difficulty associated with the use of wire ropes and which is completely eliminated by the invention is the difficulty caused when one of the ropes breaks. It is normally very difficult to compensate for a broken rope not only because of the out of balance loads immediately produced in the riser but also because of the difficulty of fitting a new rope.

What is claimed is:

1. A tensioner device for suspending and guiding a production riser in an oil production platform structure comprising a gimbal device having an inner ring and an outer ring to which the inner ring is pivoted so as to be swingable about an axis which is diametrically disposed with respect to both rings, a clamping device carried by the inner ring and arranged to be clamped to a production riser, guiding means pivotally attached to the outer ring of the gimbal device at diametrically opposite points on the ring so as to be swingable about an axis which is disposed diametrically of the outer ring and is at right angles to the axis about which the inner ring is swingable, said guiding means being operative to guide the gimbal device in the platform structure in a direction at right angles to the axis about which the guiding means are swingable, and at least one pair of tensioner units each incorporating a cylinder and piston as relatively movable elements, one said element of each unit of the pair being pivoted to the inner ring at a point diametrically opposite to the point where the corresponding element of the other unit of the pair is pivoted to the inner ring, and the other elements of both units being connectible to the platform structure.

2. A tensioner device as claimed in claim 1 in which the cylinder and piston units are disposed around the riser parallel to the riser.

3. A tensioner device as claimed in claim 1 incorporating two pairs of tensioner cylinder and piston units disposed equi-angularly around the gimbal device, the cylinders of each pair being diametrically opposite one another.

4. A cylinder and piston device as claimed in claim 1 in which each tensioner cylinder and piston unit is arranged to be pivoted to a fixed part of the platform, the end of the piston projecting from each cylinder being pivotally connected to the inner ring of the gimbal device.

5. A cylinder and piston device as claimed in claim 4 in which the cylinder units are so arranged that the pistons project upwardly and the gimbal device is above the cylinder units.

6. A cylinder and piston device as claimed in claim 4 in which the cylinder units are so arranged that the pistons project downwardly and the gimbal device is below the cylinder units.

7. A cylinder and piston device as claimed in claim 1 in which the tensioner cylinder units are of the telescopic type incorporating pistons in several sections slidable within one another so as to provide a long stroke within a short closed length.

8. A cylinder and piston device as claimed in claim 1 incorporating several pairs of tensioner cylinder units in which a fluid pressure system is provided to supply operating fluid to the cylinder units and valve means are so arranged in the fluid pressure system as to provide for the separate control of the supply of fluid from the fluid pressure system to each pair of cylinder units diametrically opposite one another as an independent pair.

9. A cylinder and piston device as claimed in claim 8 incorporating pressure failure sensors connected separately to all the pairs of cylinder units and operative on sensing a pressure failure in the associated pair of cylinder units to issue a failure signal and control means arranged to receive said control signal and to be operative thereupon to disconnect that cylinder unit from the fluid pressure system and increase the pressure in the other cylinder units.

10. A tensioner device as claimed in claim 9 in which a normally closed high pressure control valve is connected between the circuit of each pair of cylinder units and a source of high pressure fluid and a low pressure control valve normally open is connected between the circuit of each pair of cylinder units and a source of low pressure fluid, a bleed off valve having a fluid discharge outlet is located in the circuit of each pair of cylinder units, said bleed off valve being arranged to be normally closed, and a control unit arranged to receive the signals from the pressure failure sensors is controllingly connected to the high and low pressure control valves and the bleed off valves, the control unit being arranged to operate such that when a pressure failure signal is received from one sensor the control unit opens the bleed off valve in the circuit of the cylinder units in which the pressure has failed, closes the high and low pressure control valves in that circuit, closes the low pressure valve in the circuit of each other pair of cylinder units and opens the high pressure control valve in the circuit of said each other pair of cylinder units.

11. A tensioner device as claimed in claim 10 incorporating a manual control system operative to override the control unit.

* * * * *